US005947815A

United States Patent [19]

Danforth

[11] Patent Number: 5,947,815

[45] Date of Patent: Sep. 7, 1999

[54] AIR REGISTER FILTERING SYSTEM

[76] Inventor: Doug A. Danforth, 34 Braun, Kitchener, Ontario, Canada

[21] Appl. No.: 08/634,591

[22] Filed: Apr. 18, 1996

[51] Int. Cl.[6] ..... F24F 13/28

[52] U.S. Cl. ..... 454/289; 55/385.2; 55/493; 55/506

[58] Field of Search ..... 55/385.2, 493, 55/506, 511; 454/284, 289, 290, 309, 322

[56] References Cited

U.S. PATENT DOCUMENTS

| | | | |
|---|---|---|---|
| 2,080,726 | 5/1937 | Lowinger | 454/289 X |
| 2,138,874 | 12/1938 | Myers . | |
| 2,203,311 | 6/1940 | Sinclair | 454/307 |
| 2,743,660 | 5/1956 | Scherff | 454/289 |
| 4,917,862 | 4/1990 | Kraw et al. . | |
| 5,525,145 | 6/1996 | Hodge | 454/309 |
| 5,766,285 | 6/1998 | Killman | 55/493 X |

*Primary Examiner*—Harold Joyce

[57] ABSTRACT

An air register filtering system for mounting to an existing air register thereby removing particles of dust, pollen and other debris that do not get trapped by a furnace filter before being blown into the room providing cleaner air for the user and reducing the need for dusting. The system includes an air register a filter retaining structure engaging the existing air register, and a filter secured within the filter retaining structure.

8 Claims, 3 Drawing Sheets

AIR REGISTER FILTERING SYSTEM

BACKGROUND OF THE INVENTION

1. Field of the Invention

The present invention relates to Air Filter Devices and more particularly pertains to a new Air Register Filtering System for mounting to an existing air register thereby removing particles of dust, pollen and other debris that do not get trapped by a furnace filter before being blown into the room providing cleaner air for the user and reducing the need for dusting.

2. Description of the Prior Art

The use of Air Filter Devices is known in the prior art. More specifically, Air Filter Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Air Filter Devices include U.S. Pat. No. 4,514,197; U.S. Pat. No. 4,743,280; U.S. Design Patent 344,327; U.S. Pat. No. 5,240,487; U.S. Pat. No. 5,266,091 and U.S. Pat. No. 5,176,570.

While these devices fulfill their respective, particular objectives and requirements, the aforementioned patents do not disclose a new Air Register Filtering System. The inventive device includes an existing air register, a filter retaining structure engaging the existing air register, and a filtering means secured within the filter retaining structure.

In these respects, the Air Register Filtering System according to the present invention substantially departs from the conventional concepts and designs of the prior art, and in so doing provides an apparatus primarily developed for the purpose of mounting to an existing air register thereby removing particles of dust, pollen and other debris that do not get trapped by a furnace filter before being blown into the room providing cleaner air for the user and reducing the need for dusting.

SUMMARY OF THE INVENTION

In view of the foregoing disadvantages inherent in the known types of Air Filter Devices now present in the prior art, the present invention provides a new Air Register Filtering System construction wherein the same can be utilized for mounting to an existing air register thereby removing particles of dust, pollen and other debris that do not get trapped by a furnace filter before being blown into the room providing cleaner air for the user and reducing the need for dusting. The general purpose of the present invention, which will be described subsequently in greater detail, is to provide a new Air Register Filtering System apparatus and method which has many of the advantages of the Air Filter Devices mentioned heretofore and many novel features that result in a new Air Register Filtering System which is not anticipated, rendered obvious, suggested, or even implied by any of the prior art Air Filter Devices, either alone or in any combination thereof.

To attain this, the present invention generally comprises an existing air register, a filter retaining structure engaging the existing air register, and a filtering means secured within the filter retaining structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Air Register Filtering System apparatus and method which has many of the advantages of the Air Filter Devices mentioned heretofore and many novel features that result in a new Air Register Filtering System which is not anticipated, rendered obvious, suggested, or even implied by any of the prior art Air Filter Devices, either alone or in any combination thereof.

It is another object of the present invention to provide a new Air Register Filtering System which may be easily and efficiently manufactured and marketed.

It is a further object of the present invention to provide a new Air Register Filtering System which is of a durable and reliable construction.

An even further object of the present invention is to provide a new Air Register Filtering System which is susceptible of a low cost of manufacture with regard to both materials and labor, and which accordingly is then susceptible of low prices of sale to the consuming public, thereby making such Air Register Filtering System economically available to the buying public.

Still yet another object of the present invention is to provide a new Air Register Filtering System which provides in the apparatuses and methods of the prior art some of the advantages thereof, while simultaneously overcoming some of the disadvantages normally associated therewith.

Still another object of the present invention is to provide a new Air Register Filtering System for mounting to an existing air register thereby removing particles of dust, pollen and other debris that do not get trapped by a furnace filter before being blown into the room providing cleaner air for the user and reducing the need for dusting.

Yet another object of the present invention is to provide a new Air Register Filtering System which includes an existing air register, a filter retaining structure engaging the existing air register, and a filtering means secured within the filter retaining structure.

Even still another object of the present invention is to provide a new Air Register Filtering System wherein the user is able to secure the present invention to an existing air register.

Another object of the present invention is to provide a new Air Register Filtering System that removes dust, pollen and other debris that is not captured by the furnace filter providing cleaner air for the user and reducing the need for dusting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
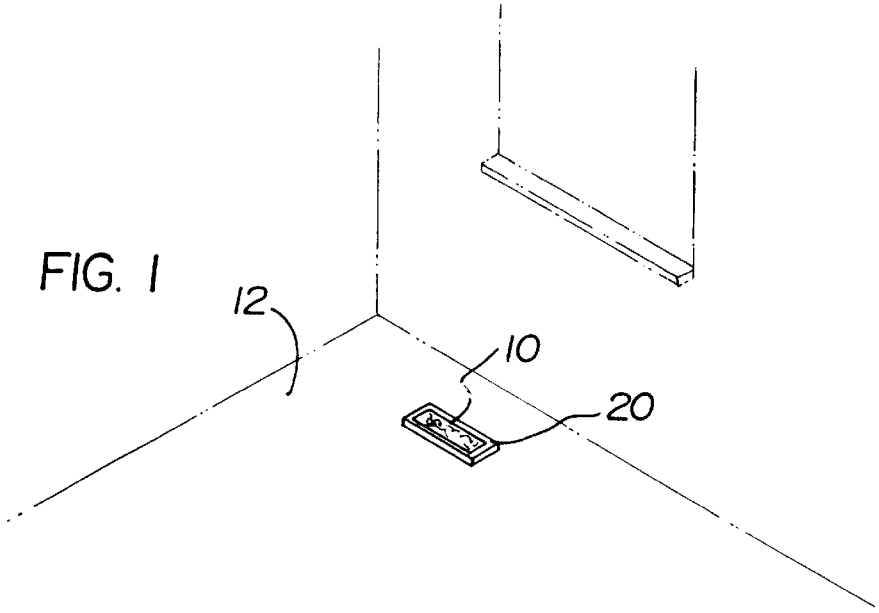
FIG. 1 is an upper perspective view of a new Air Register Filtering System secured to an existing air register according to the present invention.
Figure 2:
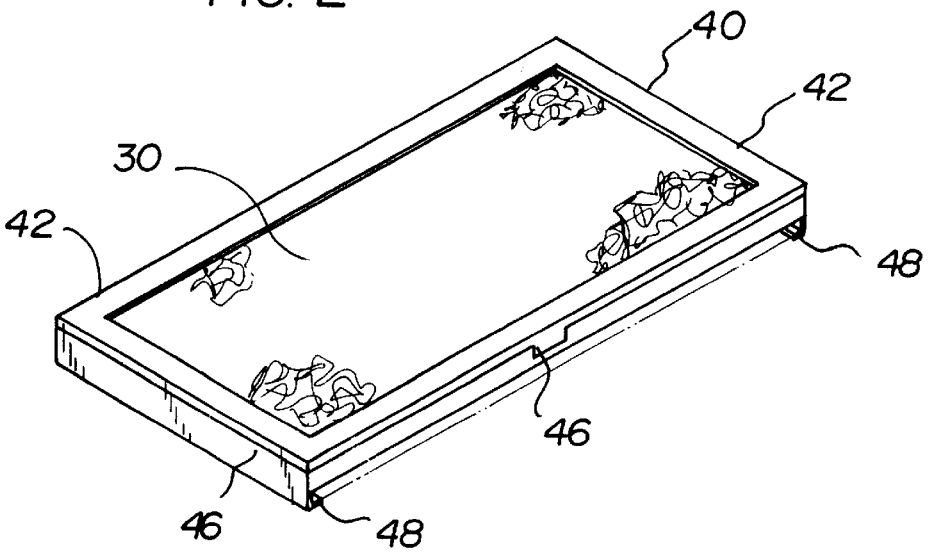
FIG. 2 is an exploded upper front perspective view thereof.
Figure 3:
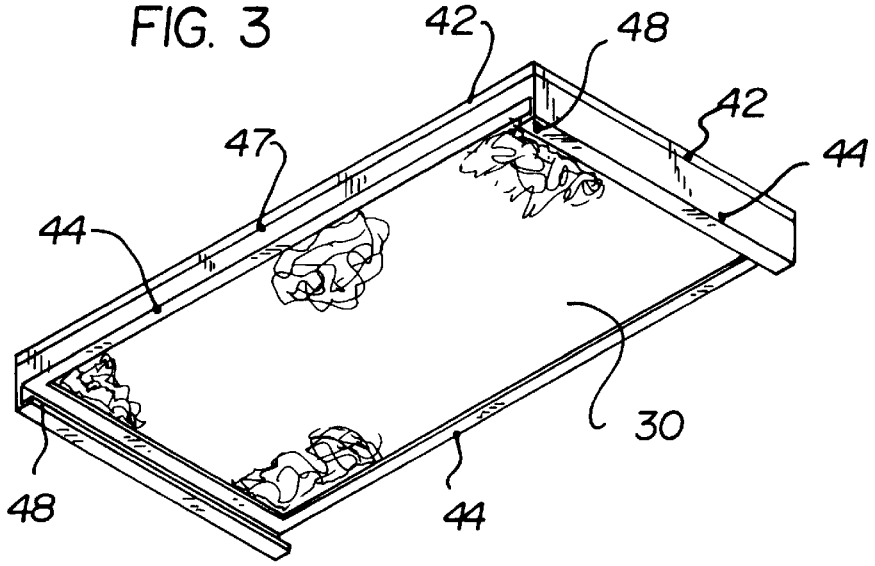
FIG. 3 is an lower side perspective view of the present invention.

With reference now to the drawings, and in particular to FIGS. 1 through 6 thereof, a new Air Register Filtering System embodying the principles and concepts of the present invention and generally designated by the reference numeral 10 will be described.

More specifically, it will be noted that the Air Register Filtering System 10 comprises an existing air register 20, a filter retaining structure 40 engaging the existing air register 20, and a filtering means 30 secured within the filter retaining structure 40.

Figure 4:
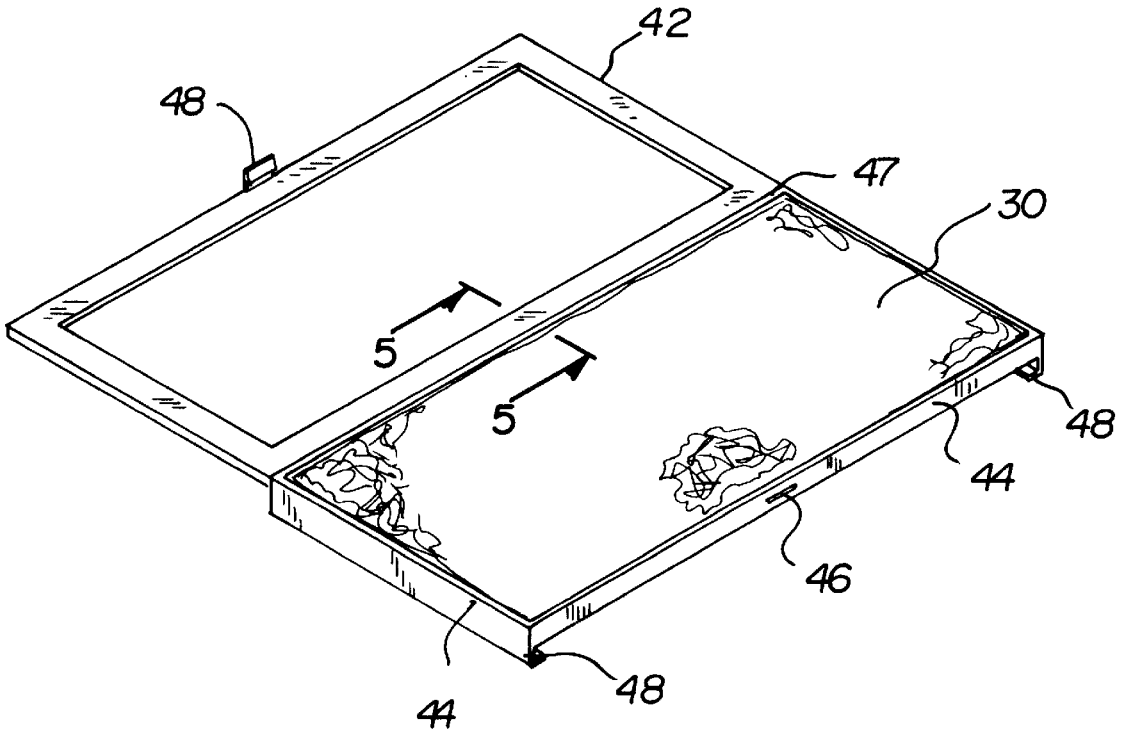
FIG. 4 is an exploded upper front perspective of the invention with the upper retaining member retracted.
Figure 5:
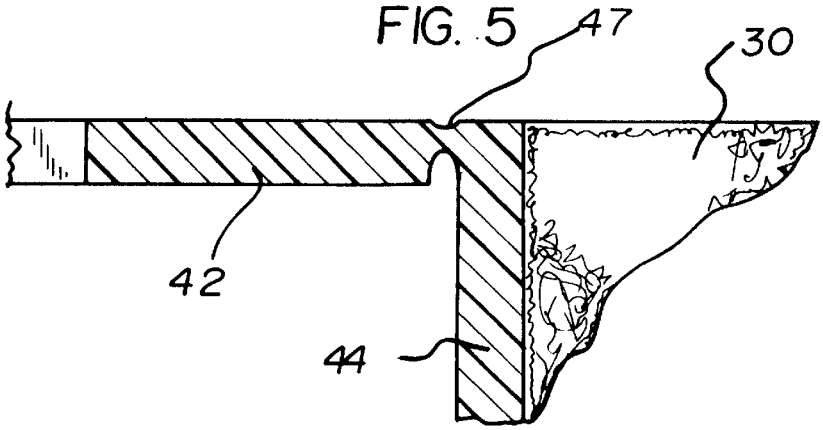
FIG. 5 is a cross sectional view taken along line 5—5 of FIG. 4.
Figure 6:
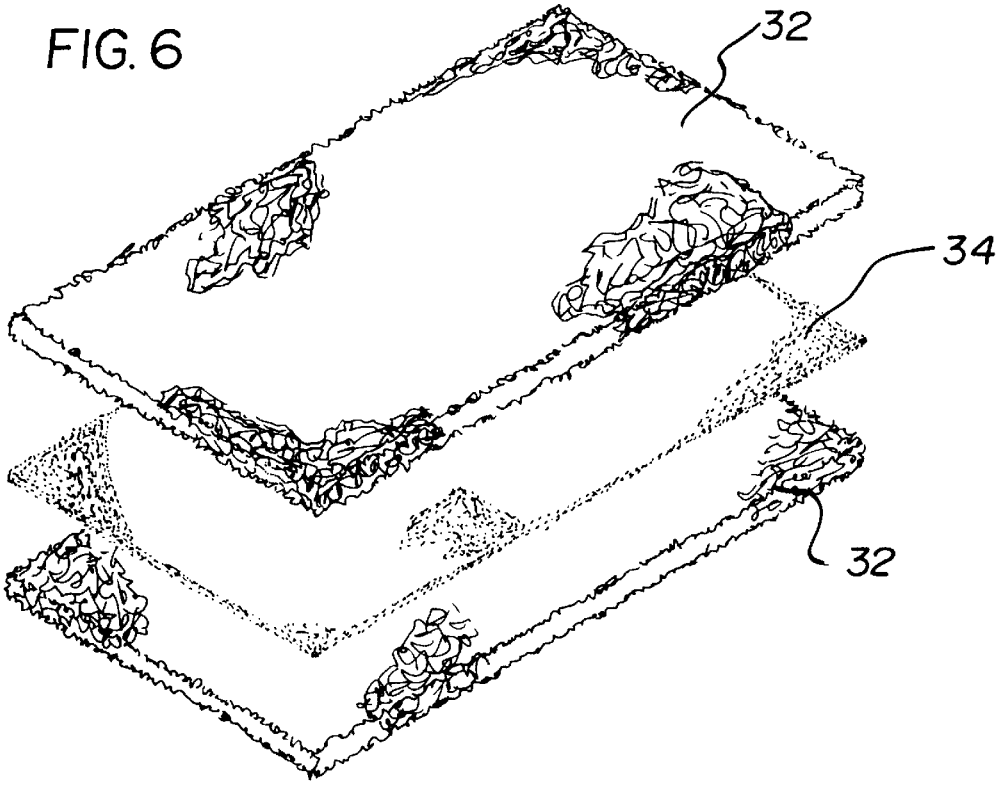
FIG. 6 is an upper perspective view of the filtering means.

As best illustrated in FIGS. 1 through 6, it can be shown that a lower retaining member 44 is formed to the border shape of the existing air register 20 and includes a hollow center allowing the air from the existing air register 20 to flow through. An upper retaining member 42 is formed to the border shape of the existing air register 20 with a hollow center allowing the air from the existing air register 20 to flow through. The upper retaining member 42 is secured pivotally to the lower retaining member 44 by a hinging means allowing the user to replace the filtering means 30 as shown in FIGS. 4 and 5 of the drawings. A latching means 46 is secured to the upper retaining member 42 and the lower retaining member 44 securing the filtering means 30 within the filter retaining structure 40. At least one L-shaped mounting member 48 is secured to an end of the lower retaining member 44 opposite of the upper retaining member 42 allowing the user to secure the present invention to the existing air register 20. At least one air filter 32 is positioned between the upper retaining member 42 and the lower retaining member 44 capturing dust, pollen and other debris before it enters the air of the building. At least one scented air filter 34 is included in the filtering means 30 providing a pleasant scent throughout the building as shown in FIG. 6 of the drawings.

In use, the user engages the present invention to the existing air register 20 by sliding the filter retaining structure 40 onto the existing air register 20, more specifically, the L-shaped mounting member engages the upper ridge of the existing air register 20. When the furnace forces the air through the existing air register 20, the filtering means 30 captures dust, pollen and other debris before it enters the air of the building. When the filtering means 30 becomes dirty, the user pivotally retracts the upper retaining member 42 exposing the filtering means 30 which is then removed and cleaned.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air resister filtering system comprising:

an existing air register;

a filter retaining structure engaging the existing air register; and a filtering means secured within the filter retaining structure wherein the filter retaining structure includes:

a lower retaining member formed to the border shape of the existing air register with a hollow center;

an upper retaining member formed to the border shape of the existing air register with a hollow center wherein the upper retaining member is secured pivotally to the lower retaining member by a hinging means;

a latching means secured to the upper retaining member and the lower retaining member; and at least one L-shaped mounting member secured to an end of the lower retaining member opposite of the upper retaining member and wherein the L-shaped mounting member engages the existing air register.

2. The air register filtering system of claim 1 wherein the filtering means includes at least one air filter positioned between the upper retaining member and the lower retaining member.

3. The air resister filtering system of claim 1 wherein the filtering means further includes at least one scented air filter.

4. An air register filtering system comprising:

an air register;

a filter retaining structure engaging the air register; and a filtering means secured in the filter retaining structure;

wherein the filter retaining structure includes:

a lower retaining member formed to the shape of the air register with a hollow center;

an upper retaining member formed to the shape of the air register with a hollow center wherein the upper retaining member is secured pivotally to the lower retaining member by a hinging means;

a latching means secured to the upper retaining member and the lower retaining member; and at least one L-shaped mounting member secured to an end of the lower retaining member opposite of the upper retaining member and wherein the L-shaped mounting member engages the air register.

5. The air register filtering system of claim 1 wherein the filtering means includes at least one air filter positioned between the upper retaining member and the lower retaining member.

6. The air register filtering system of claim 1 wherein the filtering means further includes at least one scented air filter.

7. An air register filter for mounting on an air register having opposite edges oriented substantially parallel to each other, said filter comprising:

a filter retaining structure adapted for engaging an air register; and a filter secured in the filter retaining structure;

wherein the filter retaining structure includes:

a lower retaining member having opposite edge portions oriented substantially parallel to each other;

an upper retaining member pivotally mounted on the lower retaining member by a hinge structure;

a latch structure for securing the upper retaining member and the lower retaining member against pivoting with respect to each other; and a pair of L-shaped mounting members, each L-shaped mounting member being secured to one of the opposite edge portions in an opposed relationship such that the L-shaped mounting members are adapted to engage the opposite edges of the air register.

8. The air register filter of claim 7 wherein the filter includes at least one scented air filter.

* * * * *